United States Patent [19]

Youngstrand

[11] Patent Number: 4,601,767

[45] Date of Patent: Jul. 22, 1986

[54] VINSOL COATING IN SWEETIE BARREL

[75] Inventor: Richard H. Youngstrand, Woodville, Fla.

[73] Assignee: Olin Corporation, Stamford, Conn.

[21] Appl. No.: 696,057

[22] Filed: Jan. 29, 1985

[51] Int. Cl.[4] ..... D03D 23/00

[52] U.S. Cl. ..... 149/109.6; 149/4; 149/11; 149/98; 149/100; 264/36

[58] Field of Search ..... 149/98, 100, 109.6, 149/4, 11; 264/3 C

[56] References Cited

U.S. PATENT DOCUMENTS 4,089,716 5/1978 Goddard et al. ..... 149/22

4,106,960 8/1978 Brachert et al. ..... 149/98

*Primary Examiner*—Stephen J. Lechert, Jr.

*Attorney, Agent, or Firm*—Bruce E. Burdick

[57] ABSTRACT

A process for producing double base propellant powders deterred with Vinsol by diluting the Vinsol with isopropyl alcohol or similar solvent and then adding the solvent Vinsol solution to the propellant powder in a sweetie barrel in an intermittent manner proceeded by addition of graphite.

10 Claims, 1 Drawing Figure

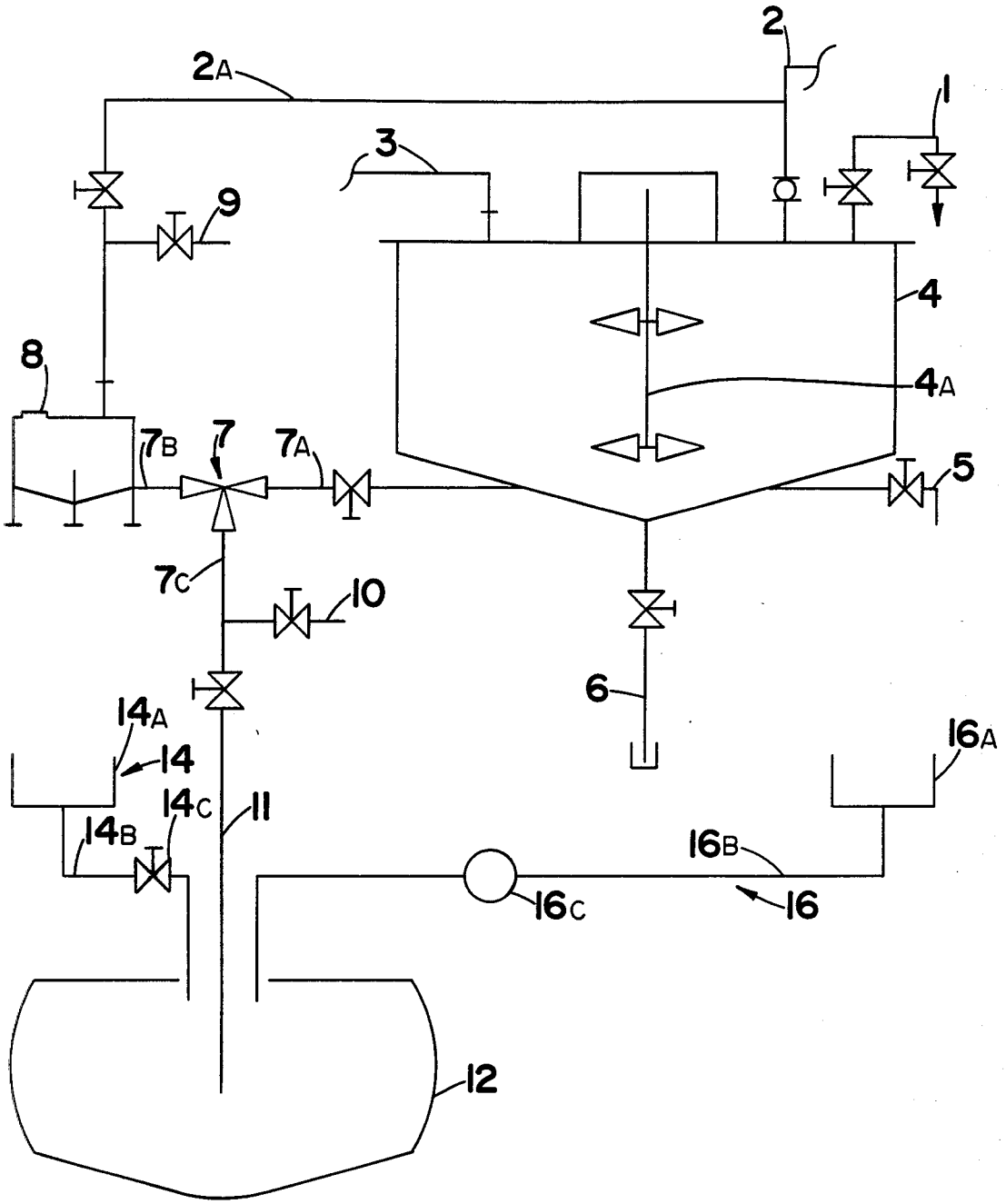
2
2A
1
3
9
4
8
4A
7B
7
7A
5
7C
10
6
14A
14
16A
14C
11
14B
16B
16C
16
12

VINSOL COATING IN SWEETIE BARREL

This invention relates to the manufacture of globular propellant powder and particularly to deterred double base (nitrocellulose/nitroglycerine) powders, proposed classification class 149, subclass 98.

Various compounds, some inorganic and some organic, have been tested or used over the years as deterrent coatings for double base propellants. In the past, one of the lesser known deterrent coatings has been Vinsol, a dark, high-melting, aliphatic, hydrocarbon-insoluble, themoplastic resin produced by Hercules which is chemically derived from certain southern pine tree stumpwood. However, despite test ballistic data which indicates Vinsol's utility as a propellant deterrent coating, the material has not been very satisfactory for commercial production process because it is so sticky. A method is needed to reliably apply uniform Vinsol deterrent coatings.

The present invention provides a solution to this problem by diluting the Vinsol with isopropyl alcohol or similar solvent and then adding the solvent Vinsol solution to the propellant powder in a sweetie barrel in an intermittent manner preceeded by addition of graphite.

The invention will be better understood by reference to the attached FIG. 1 which is a schematic process flow diagram showing typical equipment used in the process of the invention.

Referring to FIG. 1, a fill line 1, relief vent line 2 and level gauge line 3 are connected to a mixing tank 4 having an agitator 4*a* therein. The tank 4 is in turn connected to a sample tap line 5, a drain line 6 and a three-way control valve 7. Valve 7 is also connected to the bottom of a reservoir tank 8 and to a feed line 11 leading to a sweetie barrel 12, line 11 being provided with a flush line 10. Tank 8 is also connected to vent line 2 through a line 2*a* which also has a separate vent 9.

Tank 4 is filled with Vinsol and IPA (isopropyl alcohol) liquids through line 1 to a desired level as indicated by level indicator 3 and the liquid contents are then stirred by agitator 4*a*. When the mixture is ready for use, a predetermined portion is drawn off through valve 7 to reservoir 8, with make up solution being then added to tank 4 via line 1.

Valve 7 is then adjusted to close the line 7*a* leading from tank 4 and instead put line 7*b* and 7*c* in communication so that solution can drain from reservoir 8 through line 7*c* to line 11 and from line 11 into sweetie barrel 12.

In addition to the liquid flow and relief lines above described, their are two solids feeding system 14 and 16. System 14 feeds powder in predetermined quantities into sweetie barrel 12 while system 16 feeds graphite powder into sweetie barrel 12. Propellant powder feed system 14 includes a powder reservoir 14*a* a conveyor or pneumatic feeding line 14*b* and some means of control such as a valve 14*c*, or, alternatively, powder could simply be manually added to barrel 12. Graphite feed system 16 includes a graphite powder reservoir 16*a* a feed line 16*b* and a graphite feeder 16*c*, such as a helical screw type feeder.

It has been, as part of the invention herein, found that selective intermittent operation of valve 7 during the Vinsol addition to powder in barrel 12 results in elimination of powder clumps and elimination of powder buildup on the sides of the sweetie barrel. Heretofore it has been thought that Vinsol coatings were simply impossible to apply uniformly in a sweetie barrel to double base propellant powder. A cycling rate of 5 minutes on, 5 minutes off during addition of Vinsol/IPA solution allowed sufficient time for the Vinsol/IPA liquid to be absorbed by the double base propellant powder, which was a Ball Powder® brand smokless double base (NC/NG) oblate spheriodal propellant powder produced by Winchester Group, Olin Corporation at its St. Marks, Fla. plant. Other, i.e. more rapid cycling of flow rate could also be used.

Once the Vinsol, IPA solution has been applied to the powder, the heated barrel is allowed to continue rotating for a time period sufficient to cook-off (evaporate) substantially all of the IPA and then is gradually cooled to ambient while continuing to rotate. The finished result is a double base powder which has the coating previously considered unachievable by practical means, namely a uniform Vinsol coating.

What is claimed is:

1. A process for producing deterred double base propellant powder, which comprises the steps of:

(a) adding a quantity of graphite powder to sweetie barrel:

(b) Adding a quantity of propellant powder to a sweetie barrel;

(c) Heating said sweetie barrel to a predetermined temperature;

(d) Mixing a quantity of a high-melting, hydrocarbon, sticky thermoplastic deterrent resin with a quantity of a diluent solvent, the solvent having an evaporation point below that of the temperature of the heated sweetie barrel;

(e) intermittently adding the mixed sticky deterrent resin and solvent solution to the powder in the sweetie barrel while rotating the sweetie barrel;

(f) Continuing to rotate the powder and solution together in the barrel for a sufficient time following the addition of the solution to allow the solvent to substantially entirely evaporate.

2. The method of claim 1 further comprising the step of:

cooling the barrel to ambient temperature while continuing to rotate the barrel

3. The method of claim 1 wherein the periods of addition and non-addition during said intermittent addition step are each within the range of from about 3 to about 7 minutes.

4. The method of claim 3 wherein the continued heated rotation from the resin/solvent addition is for a period of at least about 15 minutes.

5. The method of claim 4 wherein the cooling off rotation period is at least about 25 minutes.

6. The method of claim 5 wherein said sticky resin is derived from pine stumpwood.

7. The method of claim 4 wherein said sticky deterrent resin is derived from pine stumpwood.

8. The method of claim 3 wherein said sticky resin is derived from pine stumpwood.

9. The method of claim 2 wherein said sticky resin is derived from pine stumpwood.

10. The method of claim 2 wherein said sticky resin in derived from pine stumpwood.

* * * * *